US006928660B2

(12) United States Patent
Park

(10) Patent No.: US 6,928,660 B2
(45) Date of Patent: Aug. 16, 2005

(54) COATED HEADBAND FOR A CAP

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 127 days.

(21) Appl. No.: 10/308,151

(22) Filed: Dec. 3, 2002

(65) Prior Publication Data

US 2004/0103468 A1 Jun. 3, 2004

(51) Int. Cl.[7] ..... A42B 1/00
(52) U.S. Cl. ..... 2/181; 2/195.1
(58) Field of Search ..... 2/181, 181.4, 195.1, 2/195.2, 195.3

(56) References Cited

U.S. PATENT DOCUMENTS

| | | | | | |
|---|---|---|---|---|---|
| 2,106,075 | A | * | 1/1938 | Tabley | 2/181 |
| 4,406,021 | A | | 9/1983 | Bloom | |
| 4,481,681 | A | | 11/1984 | Hankin | |
| 4,632,817 | A | | 12/1986 | Yazu et al. | |
| 5,175,887 | A | | 1/1993 | Kim | |
| 5,613,248 | A | | 3/1997 | Young | |
| 5,715,540 | A | * | 2/1998 | Cho | 2/195.3 |
| 5,915,534 | A | | 6/1999 | May | |
| 5,920,910 | A | | 7/1999 | Calvo | |
| 5,983,398 | A | | 11/1999 | Kronenberger | |
| 6,067,658 | A | * | 5/2000 | Cho | 2/181 |
| 6,115,843 | A | | 9/2000 | Travalgia | |
| 6,115,844 | A | * | 9/2000 | Cho | 2/181 |
| 6,119,273 | A | * | 9/2000 | Cho | 2/195.3 |
| 6,122,774 | A | * | 9/2000 | Park | 2/181 |
| 6,199,213 | B1 | * | 3/2001 | Whang | 2/181 |
| 6,493,880 | B1 | * | 12/2002 | Lo | 2/195.2 |
| 6,546,563 | B2 | * | 4/2003 | Young | 2/181 |
| 2003/0177565 | A1 | * | 9/2003 | Park | 2/181.4 |

* cited by examiner

*Primary Examiner*—Katherine M Moran
(74) *Attorney, Agent, or Firm*—Mayer, Brown, Rowe & Maw LLP

(57) ABSTRACT

Headwear having a two-ply headband coated with a layer of polyurethane. The headwear includes a crown main body, a visor, and the headband which is preferably connected to the lower peripheral edge of the crown main body. The two-ply headband is created by folding a strip of knitted fabric, coated on one side with polyurethane, so that the polyurethane is inside the folds and then stitching the folds to secure the shape of the headband. The knitted portion of the headband demonstrates good moisture absorbency while the polyurethane layer prevents the conveyance of sweat to the crown main body and any accompanying staining that might otherwise occur. The headband stretches to fit the wearer comfortably without undue pressure during use, while also exhibiting good resilience when removed.

15 Claims, 2 Drawing Sheets

COATED HEADBAND FOR A CAP

BACKGROUND OF THE INVENTION

1. Field of the Invention

The present invention is related to the field of caps having headbands and, more particularly, to a baseball-style cap with a headband having improved perspiration absorption capability and size flexibility, while imposing less pressure for enhanced wearer comfort.

2. Description of the Related Art

A baseball style cap generally includes a crown main body, a visor portion that is secured to the forward edge of the crown and extends outwardly therefrom, a headband attached to the lower part of the inside of the crown and a size-controlling part attached to the rear edge of the crown main body.

The headband is generally constructed from more than one sheet of fabric to absorb perspiration from the forehead. Even so, many times sweat passes through the headband layers to the crown main body where unsightly staining can occur which is visible on the exterior of the cap.

The size-controlling portion is often inconvenient as the wearer may have to adjust this portion each time the cap is worn. One solution has been the use of elastic headbands made of fabric including spandex yarn in order to eliminate the need for a separate size-controlling portion. However, such elastic headbands are often very uncomfortable as they exert significant pressure on the user=s head while the cap is worn. In addition, the elastic can become stretched and lose its resilience, making proper fit for the wearer impossible.

Therefore a need exists for a headband that both absorbs and prevents the transfer of sweat therethrough, and that also provides natural and comfortable size adjustment without undue pressure and with good resilience.

SUMMARY OF THE INVENTION

In view of the foregoing, one object of the present invention is to provide a headband that naturally adjusts to the size of the wearer=s head without pressure thereto.

Another object of the present invention is a cap having a headband with good sweat absorption that prevents externally visible stains by blocking the conveyance of sweat to the crown portion through the inclusion of a polyurethane layer.

A further object of the present invention is a headband made of knit fabric having good restorative quality following expansion.

In accordance with these and other objects, the present invention is directed to a cap having a headband attached to the crown main body. The headband is woven of knit fabric, one side of which is coated with polyurethane, and has a two-ply form, being folded upon itself to form a tunnel-like shape, with the polyurethane coating to the inside of the folded area. The fabric is stitched to secure the folds, and secured against the inside edge of the crown main body such that the unfolded side contacts the wearer=s head. The resulting cap is comfortable, readily adapting to the size of the wearer=s head without pressure and providing good sweat absorption and containment capabilities.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
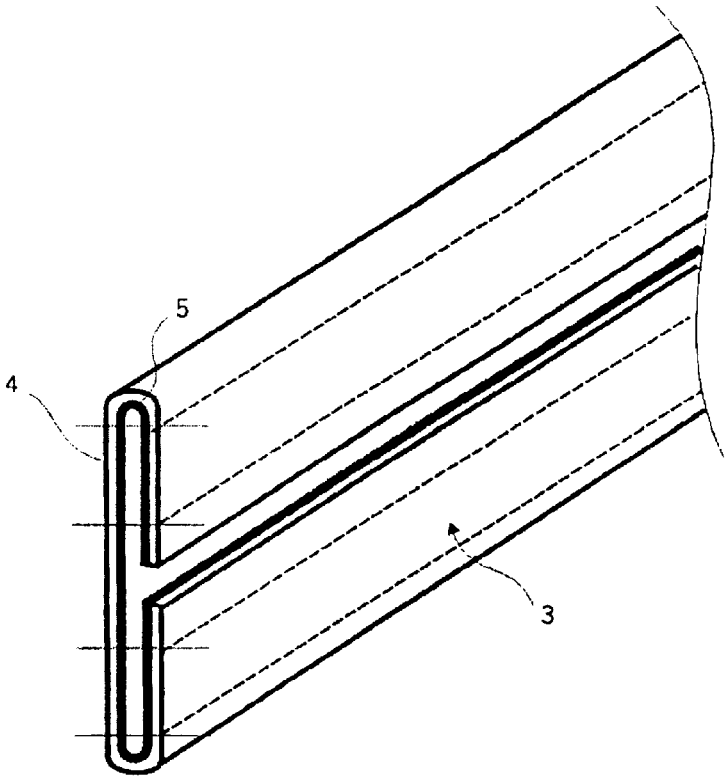
FIG. 1 is a perspective view of the coated headband in accordance with the present invention.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention and as shown in FIG. 1, the present invention is directed to a coated headband, generally designated by the reference numeral 3. The headband is made of knit fabric 4, which may be weft knit or warp knit, which is coated with a thin layer of polyurethane 5 on a surface thereof. The longitudinal edges of the coated knit fabric are folded over, with the polyurethane layer 5 to the inside of the folds, so that the resulting headband has two plys.

While more or fewer lines of stitching may be used, in the preferred embodiment shown, two lines of stitching 9*a*, 9*b* can be sewn along each folded edge for a total of four lines of stitching running longitudinally along the headband. Such stitching serves to reinforce the shape of the headband and also provides a guideline for sewing of the headband to the crown portion. The result is easier sewing of the headband to the inner brim of the crown portion and a neat and clean looking brim line.

Figure 2:
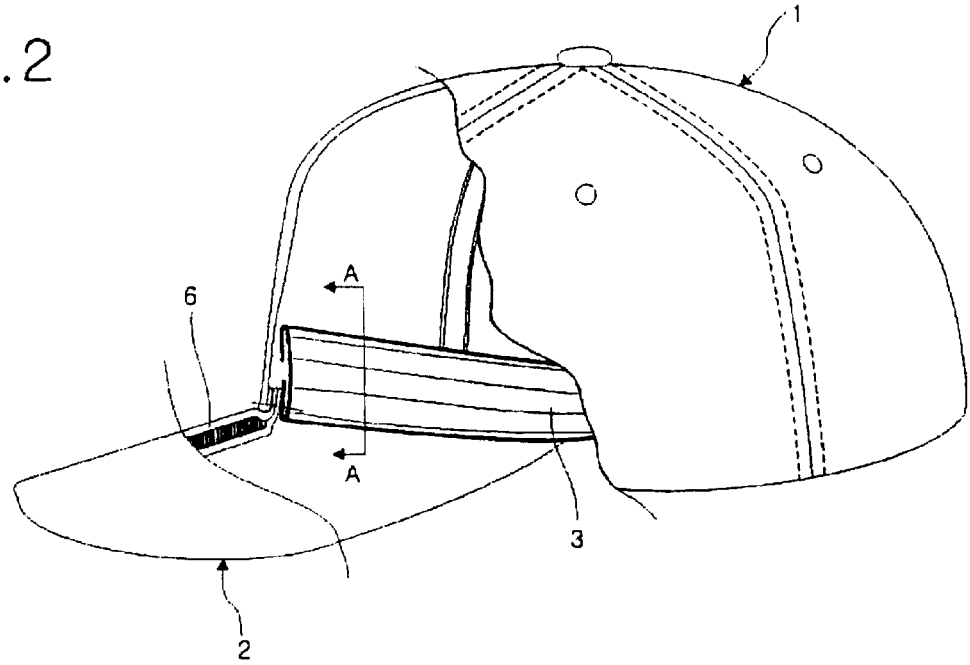
FIG. 2 is a side view with partial cut-away of the headband of FIG. 1 as incorporated within a cap.

A side view of a cap having the coated headband in accordance with the present invention is shown in FIG. 2. Such a cap typically includes a crown main body generally designated by the reference numeral 1, a visor portion generally designated by the reference numeral 2, and the headband 3 which is attached to the lower inside edge of the crown main body 1. The visor portion 2 may include a stiffening member 6 that is covered with fabric, or may be soft, i.e., fabric alone. The cap of FIG. 2 is shown in partial cut-away such that the surface of the headband 3 contacting the wearer=s head is pictured.

Figure 3:
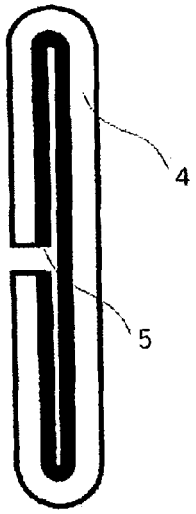
FIG. 3 is a sectional view of the headband taken along line ABA of FIG. 2.

As shown in FIG. 3, the polyurethane layer 5 covers one surface of the knit fabric 4 and is preferably folded to the inside. Alternatively, the polyurethane coating may extend over only part of one surface. For example, the longitudinal edges of the knit fabric may be left uncoated so that, when such edges are folded over, a single polyurethane layer results but with two plys of knitted fabric, one coated, one not coated. Similarly, the edge portions may be coated and the center left uncoated, with the same result of a single polyurethane layer when the edges are folded over. Other partial coating patterns may also be employed. The polyurethane layer 5 contains the sweat that is absorbed by the knit fabric 4, preventing such sweat from being conveyed to the crown main body where it might otherwise cause unattractive staining.

Figure 4:
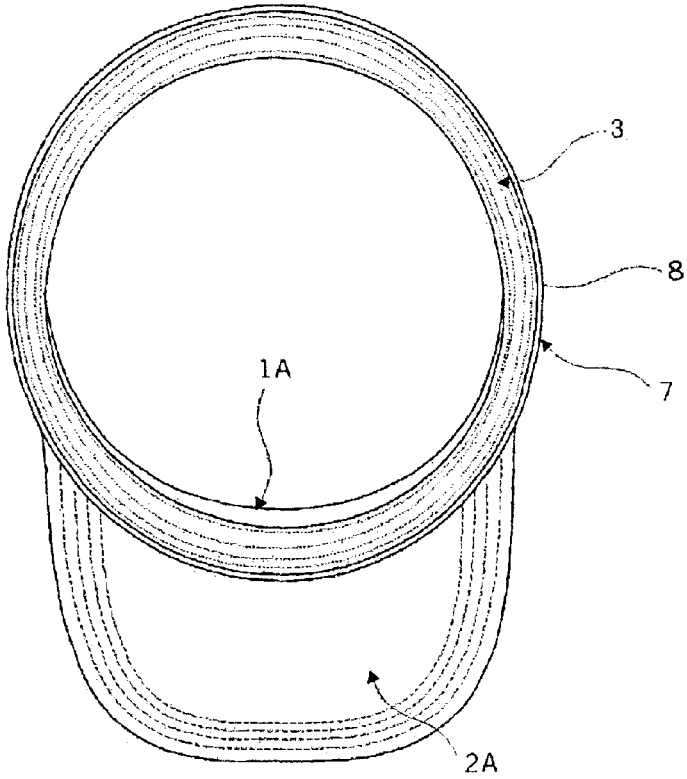
FIG. 4 is a bottom view of a visor cap having the coated headband in accordance with the present invention.

The coated headband according to the present invention may further be incorporated within a visor cap, as shown from a bottom view in FIG. 4. The visor portion 2A of the visor cap is attached to the crown part 1A, which can be made of one or more layers of fabric 8. The head fitting part, generally designated by the reference numeral 7, includes the headband 3 and the fabric 8 of the crown part surrounding the outside edge of the headband. According to the invention, the headband 3 is attached to the front portion of the crown part 1A in a manner similar to that disclosed for the cap, with the fabric 8 of the crown part providing an external covering for and extending around the wearer=s head with the headband 3. The resulting visor cap provides size control without a size controlling portion, with reduced pressure to the wearer=s head and good restorative properties when removed. The headband 3 also prevents the transfer of sweat to the crown part 1A so that unsightly staining thereof is avoided.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the coated headband may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap with a coated headband, said baseball-style cap comprising:

a crown main body having a plurality of panels joined to define a lower peripheral edge of said crown main body;

a visor portion secured to a forward portion of said lower peripheral edge of said crown main body and extending outwardly therefrom; and a headband positioned along an entirety of and sewn along said lower peripheral edge of said crown main body for attachment thereto, said headband having a knit fabric portion at least partially coated on one side with a polyurethane layer, said fabric portion being folded over said polyurethane layer and directly upon itself to form two adjoining plys.

2. The cap as set forth in claim 1, wherein said knit fabric portion of said headband is made of weft knit.

3. The cap as set forth in claim 1, wherein said knit fabric portion of said headband is made of warp knit.

4. The cap as set forth in claim 1, wherein said headband is sewn longitudinally to secure said folding.

5. The cap as set forth in claim 4, wherein said sewing includes four substantially parallel lines of stitching.

6. A headband for use with headwear, said headband comprising a fabric portion coated on one side with a layer of polyurethane and folded over said polyurethane layer and directly upon itself to form a band with two adjoining plys, said fabric portion providing moisture absorbency while said polyurethane layer prevents moisture transfer to said headwear.

7. The headband as set forth in claim 6, wherein said two adjoining plys of said headband are sewn to one another longitudinally to secure the folding.

8. The headband as set forth in claim 7, wherein said sewing includes four substantially parallel lines of stitching.

9. The headband as set forth in claim 6, wherein said fabric portion is made of weft knit.

10. The headband as set forth in claim 6, wherein said fabric portion is made of warp knit.

11. A visor cap with a coated headband, said visor cap comprising:

a crown main body having a layer of fabric with a lower peripheral edge;

a visor portion secured to a forward portion of said lower peripheral edge of said crown main body and extending outwardly therefrom; and a headband positioned along an entirety of and sewn along said lower peripheral edge of said crown main body for attachment thereto and covered on an exterior surface by said layer of fabric, said headband having a fabric portion at least partially coated on one side with a polyurethane layer, said fabric portion being folded over said polyurethane layer and directly upon itself to form two adjoining plys.

12. The visor cap as set forth in claim 11, wherein said fabric portion of said headband is made of weft knit.

13. The visor cap as set forth in claim 11, wherein said fabric portion of said headband is made of warp knit.

14. The visor cap as set forth in claim 11, wherein said two adjoining ply of said headband are sewn to one another longitudinally to secure said folding.

15. The visor cap as set forth in claim 14, wherein said sewing includes four substantially parallel lines of stitching.

* * * * *